US008851363B2

(12) United States Patent
Stahlecker

(10) Patent No.: US 8,851,363 B2
(45) Date of Patent: Oct. 7, 2014

(54) CUP OF PAPER MATERIAL AND METHOD FOR THE FABRICATION OF A CUP OF PAPER MATERIAL

(75) Inventor: Werner Stahlecker, Goeppingen (DE)

(73) Assignee: PTM Packaging Tools Machinery Pte. Ltd., Singapore (SG)

( * ) Notice: Subject to any disclaimer, the term of this patent is extended or adjusted under 35 U.S.C. 154(b) by 56 days.

(21) Appl. No.: 13/523,130

(22) Filed: Jun. 14, 2012

(65) Prior Publication Data

US 2013/0001286 A1 Jan. 3, 2013

(30) Foreign Application Priority Data

Jun. 30, 2011 (DE) ..... 10 2011 078 479

(51) Int. Cl.

| | |
|---|---|
| ***B65D 3/22*** | (2006.01) |
| ***B31B 1/32*** | (2006.01) |
| ***B65D 21/02*** | (2006.01) |
| ***B65D 3/14*** | (2006.01) |
| ***B65D 3/06*** | (2006.01) |
| ***B65D 81/38*** | (2006.01) |

(52) U.S. Cl.

CPC ..... *B65D 81/3869* (2013.01); *B65D 3/22* (2013.01); *B65D 21/0233* (2013.01); *B65D 3/14* (2013.01); *B65D 3/06* (2013.01)

USPC ..... 229/403; 493/89; 493/106

(58) Field of Classification Search

USPC ..... 229/403; 220/592.17, 592.2, 592.22, 220/62.12, 62.18, 62.2; 493/89, 106–108, 493/379, 383

See application file for complete search history.

(56) References Cited

U.S. PATENT DOCUMENTS

| | | | | |
|---|---|---|---|---|
| 3,908,523 | A * | 9/1975 | Shikaya | 493/111 |
| 5,226,585 | A * | 7/1993 | Varano | 229/403 |
| 6,193,098 | B1 * | 2/2001 | Mochizuki et al. | 220/592.17 |
| 7,451,910 | B2 | 11/2008 | Frost et al. | |
| 7,481,356 | B2 | 1/2009 | Stahlecker | |
| 7,905,821 | B2 | 3/2011 | Stahlecker | |
| 7,984,846 | B2 | 7/2011 | Messerschmid et al. | |

(Continued)

FOREIGN PATENT DOCUMENTS

| | | |
|---|---|---|
| DE | 10 2004 056 932 A1 | 5/2006 |
| DE | 10 2007 024 243 A1 | 1/2008 |

(Continued)

OTHER PUBLICATIONS

European Patent Office Search Report issued in European Application No. 12 16 9119 dated Sep. 27, 2012 with English translation of Category (7 pages).

(Continued)

*Primary Examiner* — Gary Elkins

(74) *Attorney, Agent, or Firm* — Flynn, Thiel, Boutell & Tanis, P.C.

(57) ABSTRACT

A cup of a paper material having a fillable interior, formed by an at least partially conical tubular wall and a bottom wall, which bottom wall is joined to the tubular wall in the region of the bottom end of the interior in a substantially liquid-tight manner. The tubular wall delimiting the interior has at least one deforming entity and the cup includes an outer sleeve that at least partially surrounds the tubular wall, in which the outer sleeve is cohesively joined to the tubular wall in a first region above the deforming entity and in a second region below the deforming entity.

12 Claims, 2 Drawing Sheets

(56) References Cited

U.S. PATENT DOCUMENTS

| | | | | |
|---|---|---|---|---|
| 8,146,796 | B2 * | 4/2012 | D'Amato | 229/403 |
| 8,172,127 | B2 | 5/2012 | Frost et al. | |
| 8,360,263 | B2 * | 1/2013 | D'Amato | 220/592.17 |
| 2005/0205651 | A1 * | 9/2005 | Marx | 229/403 |
| 2006/0118608 | A1 | 6/2006 | Stahlecker | |
| 2006/0131317 | A1 | 6/2006 | Bresler | |
| 2006/0237465 | A1 | 10/2006 | D'Amato | |
| 2008/0023536 | A1 | 1/2008 | Frost et al. | |
| 2008/0023537 | A1 | 1/2008 | Frost et al. | |
| 2008/0029588 | A1 | 2/2008 | Messerschmid et al. | |
| 2009/0159653 | A1 | 6/2009 | Stahlecker | |
| 2009/0184020 | A1 | 7/2009 | Messerschmid et al. | |
| 2011/0281704 | A1 | 11/2011 | Messerschmid et al. | |
| 2012/0190519 | A1 | 7/2012 | Frost et al. | |

FOREIGN PATENT DOCUMENTS

| | | | | |
|---|---|---|---|---|
| DE | 10 2008 005 403 | A1 | | 7/2009 |
| DE | 10 2008 031 812 | A1 | | 12/2009 |
| GB | 2 435 255 | A | | 8/2007 |
| JP | 2001-97355 | | | 4/2001 |
| JP | 2003-128038 | A | * | 5/2003 |
| WO | WO 2010/014832 | A1 | | 2/2010 |

OTHER PUBLICATIONS

German Patent Office Search Report dated Feb. 10, 2012 (5 pages).

* cited by examiner

CUP OF PAPER MATERIAL AND METHOD FOR THE FABRICATION OF A CUP OF PAPER MATERIAL

CROSS REFERENCE TO RELATED APPLICATION

This application claims the priority of German Application No. 10 2011 078 479.9, filed Jun. 30, 2011, the disclosure of which is hereby incorporated by reference in its entirety into this application.

FIELD OF THE INVENTION

The invention relates to a cup consisting of paper material and having a fillable interior comprising a tubular wall that is at least partially conical, and a bottom wall that is joined to the tubular wall at the bottom end of its interior in a substantially liquid-tight manner, and the tubular wall delimiting the interior comprises at least one deforming entity and the cup comprises an outer sleeve at least partially surrounding the tubular wall. The invention also relates to a method for the fabrication of a cup made of paper material.

BACKGROUND OF THE INVENTION

Cups made of paper material and comprising a tubular wall and an outer sleeve are disclosed in the German laid-open patent application DE 10 2004 056 932 A1. In this reference, the tubular wall of the inner cup comprises a stacking shoulder which abruptly reduces the diameter of the inner cup. The stacking shoulder serves to ensure that the base bead of the outer sleeve of another cup of the same type rests against this stacking shoulder in the stacked state of the cups. The cup described in this reference has satisfactory stacking properties. However, any stacking shoulder or any other formation jutting inwardly or outwardly from the tubular wall of such a cup always results in a reduction in the strength of the paper material in the region of said formation. Such formations, when exposed to forces acting substantially in the axial direction; that is, in a direction parallel to the longitudinal center axis of the cup, may be regarded as being a flexible weak spot of the cup. In the case of very high stacks of cups or large double-walled cups, the tubular wall of the inner cup might well be deformed by such forces in the region of the deforming entity. Such deformation may also occur as a result of the cup being filled with large quantities of liquid, for example.

It is an object of the present invention to improve a cup made of paper material and to improve the method for fabrication of a paper cup.

To this end, according to the invention, a cup made of paper material is provided which has a fillable interior comprising an at least partially conical tubular wall and a bottom wall that is joined to the tubular wall at the bottom end of the interior of the cup in a substantially liquid-tight manner, wherein the tubular wall delimiting the interior has at least one deforming entity, whilst the cup comprises an outer sleeve at least partially surrounding the tubular wall, which outer sleeve is securely bonded to the tubular wall in a first region above the deforming entity and in a second region below the deforming entity.

Not only can such attachment of the outer sleeve to the tubular wall above and below the deforming entity compensate for the reduced material strength of the inner cup occurring as a result of the presence of the deforming entity but it can also significantly stabilize the cup in the region between the two bonded joints; that is, in the region of the deforming entity. Each of the bonded joints may consist, for example, of an adhesive joint involving the application of cold glue or hot-melt adhesive, a sealed joint, for example, involving the use of heat-sealing methods involving sealing wax or an already existing PE coating, with or without the interposition of spacer elements, a welded joint, or the like i.e. bonding by atomic or molecular forces. The outer sleeve or the casing stiffens the tubular wall, since it is joined to the latter above and below the deforming entity. The outer sleeve thus absorbs forces that would otherwise act exclusively or predominantly on the tubular wall in the absence of said two joints. The peripheral deforming entities provided, for example, for stacking the cups are thus more stable, and higher stacks of cups are thus made possible, that is to say, a greater number of cups can be stacked. The ability to destack the cups is maintained even following transportation over large distances. The cup stiffened in the manner proposed by the invention imparts a comfortable feel to the user, since the filled cup is more stable. More specifically, the outer sleeve can move only slightly or not at all toward the tubular wall of the inner cup when the user holds a filled cup of this type in the hand, which is not the case with a conventional cup not having the two joints provided by the invention. The stabilization of the tubular wall of the inner cup by the outer sleeve can also serve, for example, to make it possible to use material of reduced strength for the inner cup, since the stability of the inner cup is, of course, partly governed by the outer sleeve or the casing. According to the invention, it is possible to stiffen all types of peripheral deforming entities in a tubular wall of a paper cup by the provision of a joint between the outer sleeve and the tubular wall of the inner cup above and below the deforming entity. Apart from imparting a stiffening effect, the two joints can at the same time join the outer sleeve to the inner cup.

In a development of the invention, at least one of the joints between the tubular wall and the outer sleeve is provided by means of an adhesive fillet applied to the tubular wall and/or to the outer sleeve.

Cold glue or hot-melt adhesive can be used, for example. The adhesive fillet can be comparatively thick and it can be applied in the form of a so-called adhesive bead in order to space the outer sleeve and the tubular wall from each even in the glued state thereof. Such a space can serve to improve the insulating properties of the paper cup.

In a development of the invention, at least one of the joints comprises a plurality of regions disposed successively as regarded in the peripheral direction of the tubular wall and outer sleeve.

In this way, the outer sleeve can be joined to the tubular wall around the periphery of the tubular wall and the outer sleeve in a first region above, and in a second region below, the deforming entity. Thus the inner cup can be stabilized in the region of the deforming entity substantially around the entire periphery of the outer sleeve and the tubular wall of the inner cup. The joint between the tubular wall and the outer sleeve stiffens the deforming entity considerably when the joints are provided just above and just below the deforming entity, for example within a region of centimeter width above and below the deforming entity. However, the use of a joint beyond this region is still effective for stabilization of the deforming entity.

In a development of the invention, at least one of the joints is provided around the entire periphery of the tubular wall and the outer sleeve.

In this way, the inner cup can be significantly stiffened around the entire periphery thereof.

In a development of the invention, the outer sleeve is located at a distance from the tubular wall, at least in certain regions.

In this way, satisfactory insulating properties are achieved. The glued joint can then be produced by means of an adhesive bead that joins together and glues the surfaces of the outer sleeve and the tubular wall located in spaced relationship to each other. In particular, the tubular wall and/or the outer sleeve are alternatively provided with spacer elements that are also joined or glued. Advantageously, the spacer elements are oriented in a direction extending from the tubular wall toward the environment. The spacer elements can be in the form of components that are not part of the tubular wall or the outer sleeve.

In a development of the invention, the deforming entity is in the form of a means for supporting a cup of the same type in the stacked state of a plurality of cups. Especially peripheral deforming entities implemented for stacking the cups are exposed to large stacking loads occurring in high stacks of cups. It is precisely in the case of such peripheral deforming entities that the invention can be used with great success.

In a development of the invention, the bottom wall and the tubular wall form a peripheral edge frame in the region of the liquid-tight joint, the deforming entity being in the form of a means for supporting the peripheral edge frame of another cup of the same type in the stacked state of a plurality of cups.

Very good stacking properties can be achieved by the use of the peripheral edge frame for stacking the cups, but the peripheral deforming entities of each of the lower cups are also exposed to heavy loads in the axial direction. The gluing of the outer sleeve to the tubular wall of the inner cup in a first region above, and in a second region below, the deforming entity, as proposed by the invention, can clearly improve the stacking properties in this case or it can make it possible to fabricate the tubular sleeve of the inner cup using a thinner material.

In a development of the invention, the cup comprises an outer sleeve that surrounds the tubular wall at least in part, the deforming entity being in the form of a means for supporting the outer sleeve of a cup of the same type in the stacked state of a plurality of cups.

Even when numerous cups are stacked by means of the bottom edge of each of the outer cups, the invention can significantly improve the stacking properties of such cups.

In a development of the invention, the deforming entity represents a constriction, at least in certain regions, in the cross-section of the interior of the cup, when regarded in the direction of extending from the open end of the cup to the bottom wall.

In this way, the cups can be securely stacked, but such a constricted cross-section also results in a noticeable reduction in the strength of the material. In this case, the invention can combine the satisfactory stacking properties of such a constricted cross-section with significant stabilization of the tubular wall of the inner cup in the region of the deforming entity.

In a development of the invention, the outer sleeve rests with its bottom edge against the external surface of the peripheral edge frame and the lower joint between the outer sleeve and the tubular wall is disposed below the deforming entity and above the bottom wall.

In this way, forces acting axially or substantially parallel to the outer sleeve and in the tubular wall of the inner cup are absorbed by the inner cup not only by way of the bonded joints but also by way of the bottom edge of the outer sleeve. In this way, the outer sleeve rests, at least in the region of its bottom edge and also in the region of the two joints, against the tubular wall of the inner cup. Thus the cup of the invention forms a particularly stable unit.

The object of the invention is also achieved by a method for the production of a cup made of paper material, which method includes the following steps: joining a conical tubular wall to the bottom wall of a cup in a substantially liquid-tight manner, incorporating a deforming entity in the tubular wall, and securely bonding an outer sleeve to the tubular wall in a first region above the deforming entity and in a second region below the deforming entity.

In a development of the invention, provision is made for shaping an outer sleeve into a conical component, arranging material for achieving the bonded joint on the conical tubular wall and/or on the outer sleeve of the cup at least in a first region above the deforming entity and in a second region below the deforming entity and sliding the conical component onto the cup, and gluing the conical component to the cup.

In this way, the outer sleeve can be glued to the tubular wall of the inner cup at the same time as the conical component is pushed onto the cup. This leads to very rapid and economic fabrication of the paper cup of the invention. The material applied for achieving the bonded joint may be, for example, an adhesive, sealing wax or a sealable or weldable coating of plastics material or use may be made of the already existing coating on the paper material.

In a development of the invention, the material for achieving the bonded joint is disposed on the conical tubular wall and/or the outer sleeve of the cup at least in a first region above the deforming entity and in a second region below the deforming entity, and a paper blank designed to form the outer sleeve is positioned around the conical tubular wall.

The double-walled cup of the invention may also be produced by shaping a blank to form the outer sleeve, and the cup is finished at the same time as the outer sleeve is joined to the tubular wall of the inner cup while the inner cup is at the same time stabilized in the region of the deforming entity. The material for producing the bonded joint can be applied in the peripheral direction or alternatively at right angles thereto, for example in the form of an adhesive fillet. The application of glue at right angles to the peripheral direction can additionally stabilize the deforming entity by means of the material itself, particularly the adhesive, as applied for achieving the bonded joint.

Additional features and advantages of the invention are revealed in the claims and in the following description of preferred embodiments of the invention, with reference to the drawings. Individual features of the various embodiments shown can be combined as required without going beyond the scope of the present invention.

DETAILED DESCRIPTION

Figure 1:
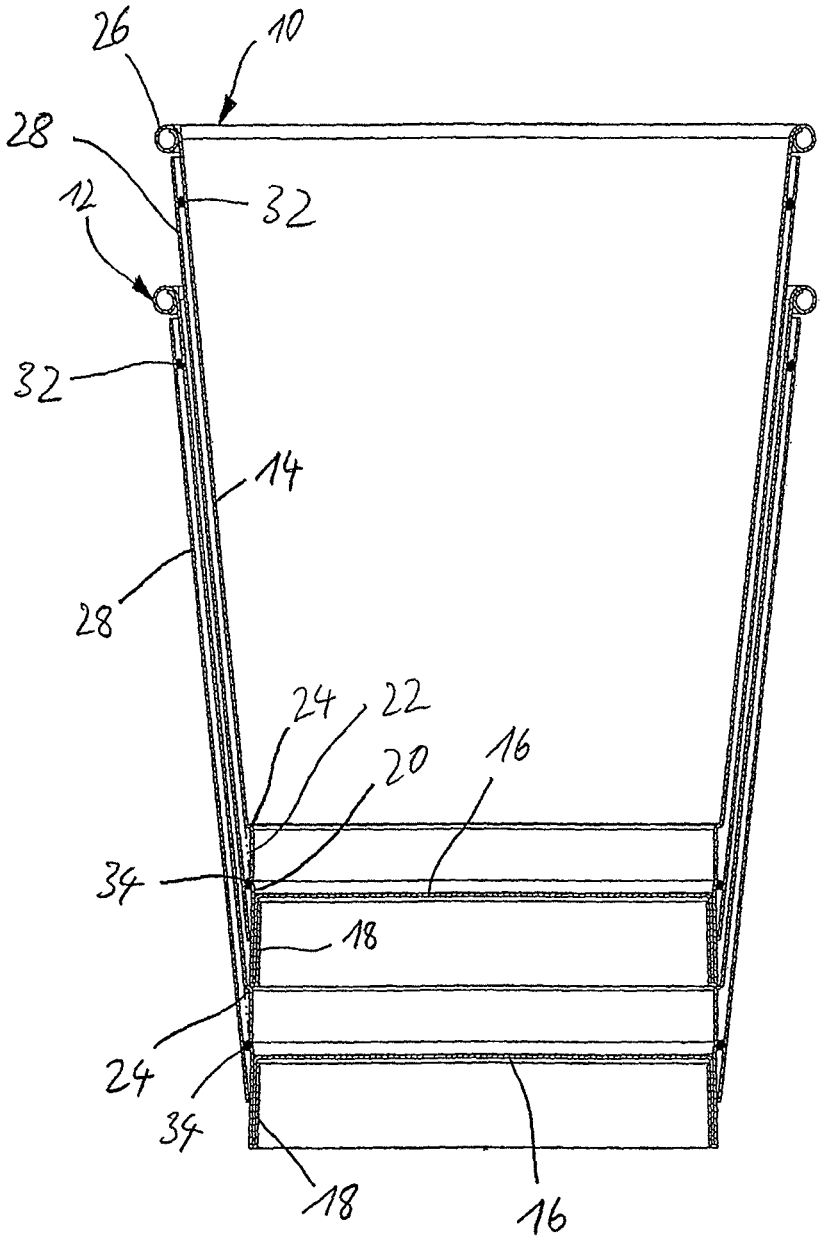
FIG. 1 is a cross-sectional view of two stacked cups of the invention according to a first embodiment.

FIG. 1 is a cross-sectional view of two cups 10, 12 of the invention, which are made of paper material and are stacked one upon the other.

The two cups are of identical design and each comprises an inner cup that forms a fillable interior and consists of a tubular wall 14 and a bottom wall 16. The tubular wall 14 and the bottom wall 16 of each cup are joined to each other in the lower region thereof in a liquid-tight manner to form a peripheral edge frame 18. The peripheral edge frame 18 is conical in shape, and the peripheral edge frame 18 of each of the two cups widens as regarded in the direction extending from the top open end of the cups 10, 12 toward their bottom end.

When the cups 10, 12 are regarded from the bottom wall toward the top, in the direction of the open end thereof, the bottom wall is directly followed by a first conically widened region 20, which is in turn followed by a cylindrical region 22. The cylindrical region 22 is approximately four to five times as long as the conically widened region 20. The cylindrical region 22 is adjoined by a shoulder-shaped deforming entity 24, starting from which the tubular wall 14 then has a uniform, conical, widened shape up to its top end. The tubular wall 14 is in each case rolled down at the top end of the cups 10, 12 to form a mouth bead 26.

The shoulder-shaped deforming entity 24 represents a constriction in the cross-section of the interior of the cups 10, 12, when regarded from the top end of the cups in the direction of the interior thereof. The shoulder-shaped deforming entity 24, also referred to as the stacking shoulder, extends around the entire periphery of the tubular wall 14.

In order to make it possible for two cups to be stacked one upon the other, the diameter at the bottom end of the peripheral edge frame is such that the peripheral edge frame 18 of the upper cup 10 can be supported on the deforming entity 24 of the lower cup 12. In this way, a plurality of cups 10, 12 can be stacked together.

Each of the cups 10, 12 is provided with a conical outer sleeve 28, the outer sleeves 28 of each cup beginning just below the mouth bead 26 of the cups 10, 12 and extending down to the region below the bottom wall 16. The outer sleeves 28 rest against the region below the bottom wall 16 with their bottom edges touching the external surface of the peripheral edge frame 18.

A top adhesive fillet 32 and a bottom adhesive fillet 34 are provided on the inner tubular wall 14 of the cups 10, 12, each of said adhesive fillets serving the purpose of gluing the tubular wall 14 to the outer sleeve 28. The adhesive fillets 32, 34 are applied in the form of adhesive beads to bridge a gap between the tubular wall 14 and the outer sleeve 28. In this way, a space of substantially constant width is maintained between the outer sleeve 28 and the tubular wall 14, when the outer sleeve 28 is regarded over the entire height thereof, with the exception of the bottom edge of the outer sleeve 28. This space serves as an insulating air gap and ensures that even a full cup 10, 12 can be held comfortably in the hand by the user without the outer sleeve 28 becoming too hot or too cold.

As can be seen from FIG. 1, the adhesive fillet 32 is disposed above the shoulder-shaped deforming entity 24 and the second adhesive fillet 34 is disposed below the shoulder-shaped deforming entity 24. Thus the outer sleeve 28 stiffens the tubular wall 14 in the region between the two adhesive fillets 32, 34, each of which, as already mentioned, forms a glued joint between the outer sleeve 28 and the tubular wall 14. The lower adhesive fillet 34 is disposed just above the bottom wall 16 at the transition between the conical region 20 and the cylindrical region 22. The upper adhesive fillet 32 is disposed just below the mouth bead 26. When the cups 10, 12 are subjected to load substantially in the axial direction; that is to say, in the direction extending from the top toward the bottom of FIG. 1 or vice versa, the outer sleeve 28 withstands forces and relieves the load on the tubular wall 14, more specifically the load on the region of the deforming entity 24 on the tubular wall 14.

Although paper material can be deformed, as can be seen with regard to the shoulder-shaped deforming entity 24, each deformation of paper material causes a certain reduction in the strength of the paper material due to the fact that the individual paper fibers are inevitably folded in the region of such a deforming entity. The connection of the outer sleeve 28 to the tubular wall 14 in a first region above the deforming entity 24 and in a second region below the deforming entity 24 can thus effectively stiffen the tubular wall 14 of the inner cup. The first, top region or the top glued joint is formed by the adhesive fillet 32 and the second, bottom region or the second glued joint is formed by the adhesive fillet 34.

The outer sleeve tapers toward the tubular wall 14 in the region below the lower adhesive fillet 34 so that a distance between the tubular wall 14 and the outer sleeve 28 diminishes continuously. The bottom edge of the outer sleeve 28 then rests against the external surface of the peripheral edge frame 18 at a level approximately half way up the peripheral edge frame 18. The outer sleeve 28 can thus be supported in its lower region against the tubular wall 14 not only by means of the second adhesive fillet 34 but also by means of its bottom edge resting against the peripheral edge frame 18. This enables a very effective absorption of forces to be achieved by the outer sleeve 28 and the tubular wall 14 or the peripheral edge frame 18.

During the fabrication of the cups 10, 12, the respective inner cup comprising the tubular wall 14 and the bottom wall 16 is produced first, and these components are then joined together in a liquid-tight manner in the region of the peripheral edge frame 18. The shoulder-shaped deforming entity 24 is then formed and the conical region 20 and the cylindrical region 22 are formed at the same time. The top mouth bead 26 is also formed.

The outer sleeve 28 is produced from a flat blank such as to form a conical component. This conical component is then pushed upwardly onto the respective inner cup over the peripheral edge frame 18 after the two adhesive fillets 32, 34 have been applied to the tubular wall 14. Concurrently with the process of sliding the conical component onto the inner cup, the internal surface of the outer sleeve is caused to rest against the adhesive fillets 32, 34 such that the outer sleeve 28 is glued to the respective inner cup.

Figure 2:
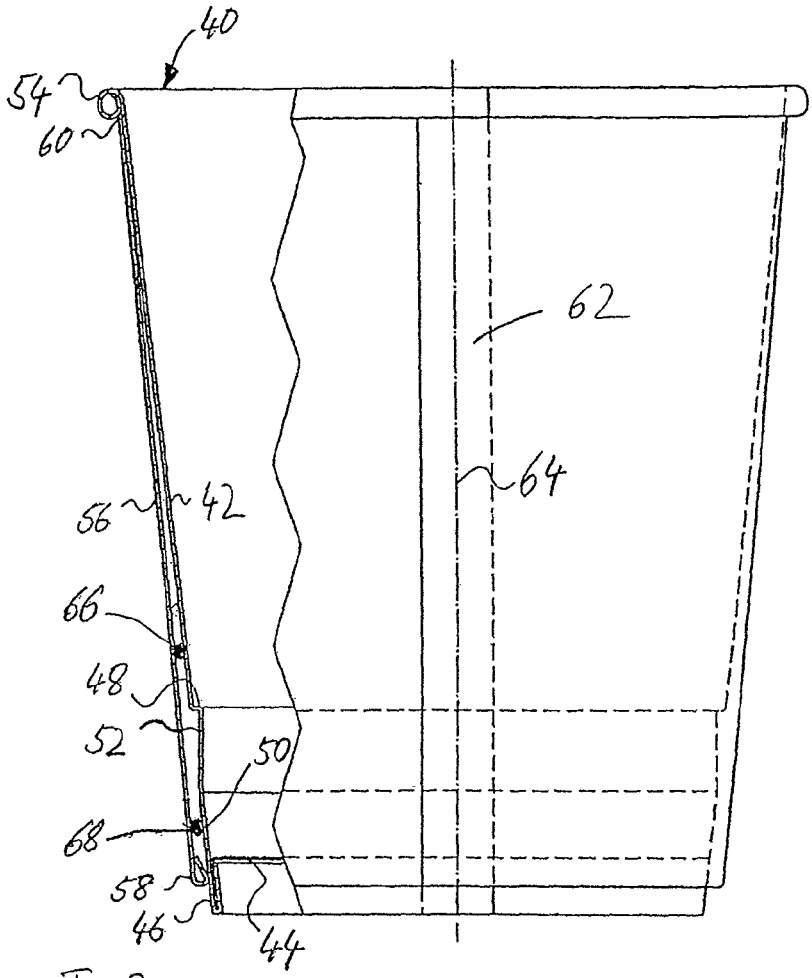
FIG. 2 is a cross-sectional view of a cup of the invention according to a second embodiment.

FIG. 2 illustrates a cup 40 of the invention made of paper material and comprising an inner cup consisting of a tubular wall 42 and a bottom wall 44 joined thereto in a liquid-tight manner in the region of a peripheral edge frame 46. The tubular wall 42 is of a conical shape in general and the peripheral edge frame 46 is also conical in shape, but unlike the cups 10, 12 shown in FIG. 1, it tapers in the direction extending from the top open end of the cup 40 toward the bottom.

The tubular wall 42 is provided with a peripheral, shoulder-shaped deforming entity 48 that represents a peripheral constriction in cross-section, when regarded from the top end of the cup 40 in the direction toward the interior thereof. When the cup is regarded from the bottom wall 44 toward the top, the bottom wall 44 is followed by a conical region 50 that then merges into a cylindrical region 52. The cylindrical region 52 terminates at the deforming entity 48. The tubular wall 42, when regarded from the deforming entity 48 toward the top, has a conically widened shape. A mouth bead 54 is formed at the top end of the tubular wall 42.

The cup 40 comprises an outer sleeve 56 having a continuous conical shape and provided with a lower bead 58 at its bottom end. The lower bead 58 rests against the external surface of the peripheral edge frame 46 below the bottom wall 44. The outer sleeve 56 rests with its top edge 60 against the mouth bead 54 of the tubular wall 42. The top edge 60 of the outer sleeve 56 is inserted into a space between the internal surface of the mouth bead 54 and the conical portion of the tubular wall 42. Thus there is no air gap present between the outer sleeve 56 and the tubular wall 42 in the top region of the cup 40, but the space between the outer sleeve 56 and the tubular wall 42 increases in width as regarded in the direction extending from the top end of the cup 40 toward the peripheral edge frame 46. The outer sleeve 56 is produced from a flat blank and glued in an overlap region 62 so that the outer sleeve 56 forms an overall conical component. The longitudinal center axis of the cup 40 is denoted by reference numeral 64.

The outer sleeve 56 is glued to the tubular wall 42 of the inner cup in a first region above the deforming entity 48 by means of a peripheral adhesive fillet 66 and it is likewise glued to the tubular wall 42 of the inner cup in a second region below the deforming entity 48 by means of a second adhesive fillet 68. The tubular wall 42 and more specifically, the region of the deforming entity 48, is thus stiffened effectively in the region between the two adhesive fillets 66, 68. Forces acting on the tubular wall 42 in the axial direction; that is, substantially parallel to the longitudinal center axis 64, can also be absorbed by the outer sleeve 56. Even in the case of very high stacks of cups, the deforming entity 48 remains stable and the stacked cups do not become jammed together.

Figure 3:
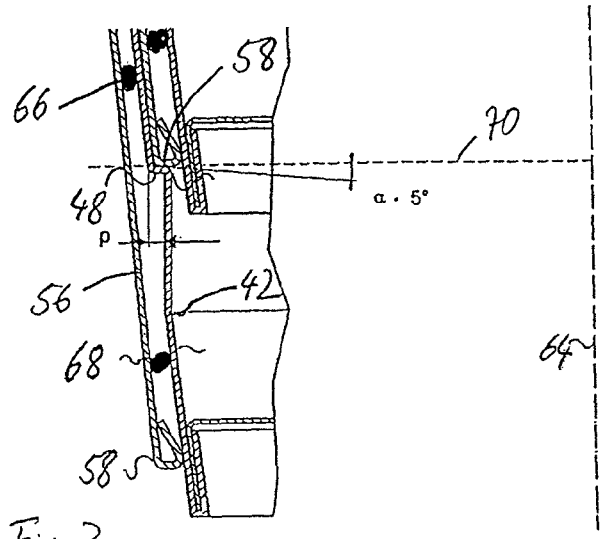
FIG. 3 is a partial cross-sectional view of two stacked cups of the type shown in FIG. 2.

The illustration shown in FIG. 3 shows two cups 40 of the type described with reference to FIG. 2, in a stacked state. More specifically, it can be seen in the figure that the lower bead 58 of the upper cup rests against the shoulder-shaped deforming entity 48 of the lower cup and it thus enables the two cups to be securely stacked one upon the other. The shoulder-shaped deforming entity 48 forms an angle of approximately 5° with a line 70 located at right angles to the longitudinal center axis 64. The deforming entity 48, when regarded in the radial direction, has a width p ranging, say, from one to two millimeters.

The illustration shown in FIG. 3 clearly shows the two adhesive fillets 66 and 68 that glue the outer sleeve 56 to the inner tubular wall 42 and ensure that the tubular wall 42 is stabilized in the region of the deforming entity 48.

The invention claimed is:

1. A cup of a paper material having a fillable interior, formed by an at least partially conical tubular wall and a bottom wall, which bottom wall is joined to said tubular wall in the region of a bottom of said interior in a substantially liquid-tight manner, wherein said tubular wall delimiting said interior has at least one deforming entity and said cup comprises an outer sleeve that at least partially surrounds said tubular wall, wherein said outer sleeve is spaced at least partially from said tubular wall, wherein said outer sleeve is securely joined to said tubular wall at a plurality of joints including a first region above said deforming entity and a second region below said deforming entity, and wherein at least one of the joints between said tubular wall and said outer sleeve is formed by an adhesive bead applied to said tubular wall and/or to said outer sleeve in order to space the outer sleeve and the tubular wall from each other even in a glued state thereof.

2. The cup as defined in claim 1, wherein at least one of the joints includes at least a plurality of regions disposed one behind the other as regarded in a peripheral direction of said tubular wall and said outer sleeve.

3. The cup as defined in claim 1, wherein at least one of the joints extends around an entire periphery of said tubular wall and said outer sleeve.

4. The cup as defined in claim 1, wherein said deforming entity is adapted to serve as a support for a cup of a same type in a stacked state of a plurality of cups.

5. The cup as defined in claim 4, wherein said bottom wall and said tubular wall form a peripheral edge frame in the region of said bottom, wherein said deforming entity is adapted to serve as a means for supporting the peripheral edge frame of a cup of the same type in the stacked state of the plurality of cups.

6. The cup as defined in claim 1, wherein, when regarded from a top end of said cup in a direction toward the interior thereof, said deforming entity forms an at least partial constriction in a cross-section of the interior of said cup.

7. The cup as defined in claim 5, wherein said outer sleeve has a bottom edge which rests against an outer surface of said peripheral edge frame and one of the joints is disposed between said outer sleeve and said tubular wall below said deforming entity and above said bottom wall.

8. A method for the fabrication of a cup of paper material, including the following method steps: joining a conical tubular wall to a bottom wall in a substantially liquid-tight manner, incorporating a deforming entity in said tubular wall, securely bonding an outer sleeve to said tubular wall in a first region above said deforming entity and in a second region below said deforming entity, spacing the outer sleeve at least partially from the tubular wall, and forming at least one joint between the tubular wall and the outer sleeve by an adhesive bead applied to said tubular wall and/or to said outer sleeve in order to space the outer sleeve and the tubular wall from each other even in a glued state thereof.

9. The method as defined in claim 8, including shaping the outer sleeve in a form of a conical component, placing material for producing a cohesive engagement on the conical tubular wall and/or on said outer sleeve of said cup at least in a first region above said deforming entity and in a second region below said deforming entity, pushing said conical component onto said tubular wall of said cup and joining said conical component to said tubular wall of said cup.

10. The method as defined in claim 8, including placing material for producing a cohesive engagement on the conical tubular wall and/or on said outer sleeve of said cup in at least one first region above said deforming entity and in a second region below said deforming entity, and winding a blank for the outer sleeve around said conical tubular wall.

11. A cup assembly of a paper material having a fillable interior, the cup assembly comprising:

a cup wall having a first wall portion and a second wall portion;

a bottom wall joined to the cup wall at a bottom region of the cup wall in a substantially liquid-tight manner;

the cup wall having at least one deforming entity dividing the cup wall into the first wall portion and the second wall portion; and an outer sleeve at least partially surrounding the cup wall;

the outer sleeve being securely joined to the cup wall in a first region above the deforming entity and in a second region below the deforming entity; and the outer sleeve abutting the cup wall at at least one of a first area above the first region and a second area below the second region;

the outer sleeve being spaced from the first wall portion of the cup wall at the first region and the second wall portion of the cup wall at the second region.

12. The cup assembly as defined in claim 11, wherein:

the outer sleeve abuts the cup wall at both the first area above the first region and the second area below the second region.

* * * * *